United States Patent [19]

Ikelheimer et al.

[11] 4,019,674

[45] Apr. 26, 1977

[54] RIGID WALLED STRUCTURES FOR CONTAINERS, FURNITURE AND THE LIKE

[75] Inventors: Gerald S. Ikelheimer; Gilbert d'Andrea, both of Yorktown Heights, N.Y.

[73] Assignee: Ikelheimer-Ernst, Inc., New York, N.Y.

[22] Filed: June 30, 1975

[21] Appl. No.: 591,571

[52] U.S. Cl. ..... 229/23 R; 229/5.5; 190/53; 206/326; 297/457

[51] Int. Cl.[2] ..... B65D 3/10

[58] Field of Search ..... 229/43, 23 BT; 206/326; D6/47, 59, 61, 71; 297/457, 445; 190/53, 54; 150/52 R

[56] References Cited

UNITED STATES PATENTS

| | | | |
|---|---|---|---|
| 2,246,057 | 6/1941 | Michaelis | 5/DIG. 1 |
| 2,389,601 | 11/1945 | De Witt | 190/53 UX |
| 2,416,497 | 2/1947 | Rodger | 190/53 UX |
| 2,437,114 | 3/1948 | Moore | 229/43 X |
| 2,690,288 | 9/1954 | Allen et al. | 229/5.5 X |
| 2,990,998 | 7/1961 | Barclay | 229/43 |
| 3,084,771 | 4/1963 | Davis | 190/53 X |
| 3,181,768 | 5/1965 | Flynn et al. | 206/326 X |
| 3,317,109 | 5/1967 | Palmer | 229/5.5 |
| 3,424,343 | 1/1969 | Hoeffelman | 229/5.5 X |
| 3,640,576 | 2/1972 | Morrison et al. | 297/457 X |

*Primary Examiner*—Davis T. Moorhead
*Attorney, Agent, or Firm*—Arthur A. March

[57] ABSTRACT

A pair of end cap members for containers such as luggage, and for furniture and the like are provided around their perimeters with internal facing U-shaped receiving and retainer slots. A unitary sheet contoured to form front, bottom and back panel portions are adapted to be received within the retainer slots. The panel portions are affixed by a bonding adhesive or the like within the U-shaped slots to form a complete unit.

8 Claims, 6 Drawing Figures

FIG. 1
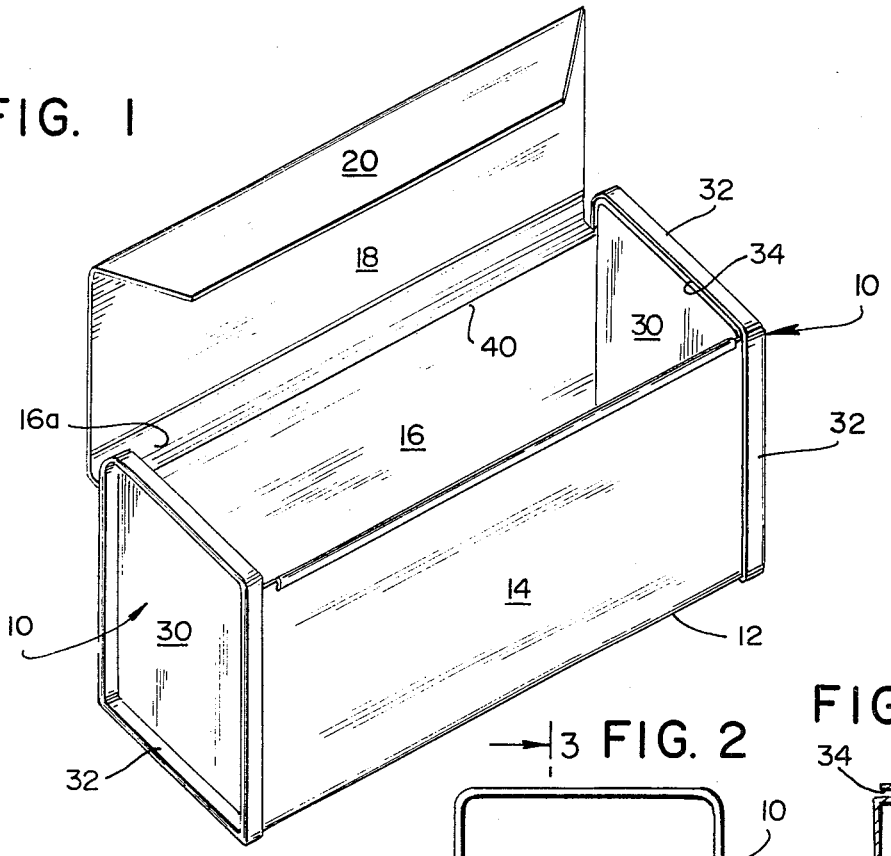
FIG. 2
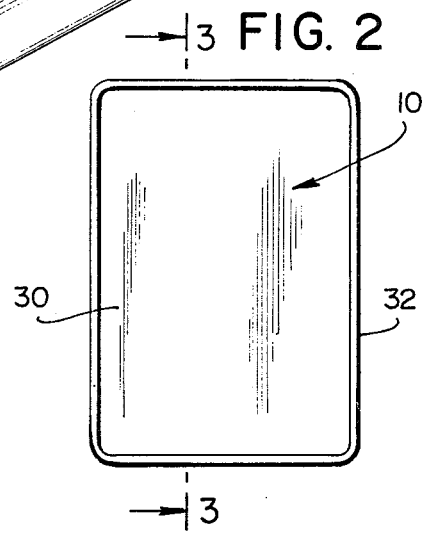
FIG. 3
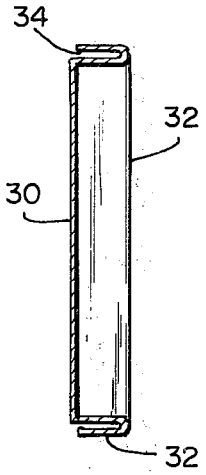
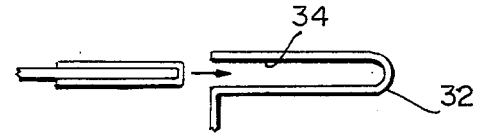
FIG. 4
FIG. 5
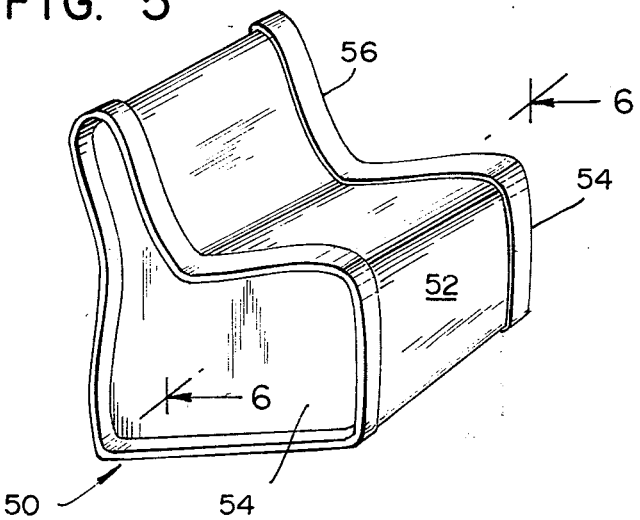
FIG. 6
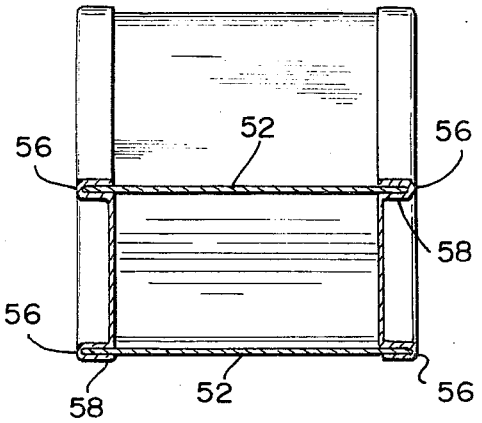

RIGID WALLED STRUCTURES FOR CONTAINERS, FURNITURE AND THE LIKE

This invention relates to rigid walled structures including containers, furniture and the like. It is particularly directed, as herein described, to an improved construction for and method of fabricating rigid walled carrying containers and chairs.

Conventional rigid walled structures such as hand luggage, sample cases, attache cases, cosmetic cases and the like generally compositely comprise a base portion, side walls and a cover portion hingedly connected thereto. Such base and cover portions are usually formed of one piece moldings of plastic or fiber glass reinforced resinous material, or one compositely constituted by a rigid frame having an outer casing formed of leather, resinous sheet material or the like and an inner lining of fabric, felt or flocked material. Such type units normally require a multiplicity of assembly operations and/or expensive materials. Because of the ultimate expenses thereof, they are relatively ill-adapted for frequent use or as readily displaceable carrying containers. In addition, the rigid walled structures for furniture such as lounge chairs and the like have not been extensively used because of the aforesaid construction and expensive manufacture.

This invention may be briefly described as an improved construction for a low cost, rigid walled, structure for carrying containers, displays, and furniture and includes, in its broader aspects, a pair of selectively contoured, premolded end-cap members of rigid resinous material having the perimetric terminal end portions of a usually unitary body member adhesively secured in integral interengaged relation therewith.

Among the advantages of the subject invention is the provision of a simple and inexpensive rigid walled structure integrally constituted of only three sub-components other than accessory hardware. A further advantage of the subject invention is the provision of a low cost rigid walled structure of improved mechanical strength that permits marked economies in quantity fabrication thereof. A third significant advantage is the overall lost cost of the components forming this invention.

The objects of this invention are the provision of an improved construction for and method of fabricating rigid walled structures.

Other objects and advantages of the subject invention will become apparent from the following portions of this specification and from the appended drawings which illustrate, in accordance with the mandate of the patent statutes, a presently preferred embodiment of a carrying case embodying and constructed in accord with the principles of this invention.

Referring to the drawings:

FIG. 1 is a generally isometric view of a rigid wall structure in the form of a carrying container, less accessory hardware, incorporating the principles of this invention;

FIG. 2 is an elevational view of an end cap element as disposed at both ends of the unit illustrated in FIG. 1;

FIG. 3 is a sectional view taken on line 3—3 of FIG. 2;

FIG. 4 is an enlarged schematic sectional view of the peripheral receiving slot portion of an end cap member as adapted to insertably receive the perimetric terminal end portion of the body member;

FIG. 5 is an oblique view of the rigid walled structure of the present invention in the form of a lounge chair, and FIG. 6 is a sectional view taken along the lines 6—6 of FIG. 5, looking in the direction of the arrows.

Referring to the drawings, there is illustrated the essentials of a carrying container in FIGS. 1–4 constructed in accord with the principles of this invention and which is integrally constituted by a pair of spaced selectively contoured end cap members 10 and an intermediate body portion 12 comprising a single piece of fibre board selectively folded to provide all of a front panel portion 14, a bottom panel portion, a back panel portion 16, a top panel portion 18 and an overlapping terminal flap portion 20. Each end cap member 10 is of generally rectangular or substantially square peripheral configuration and is pre-molded of a single piece of resinous material. Each of the cap members 10 is of unitary construction and is selectively contoured to comprise a main panel portion 30 perimetrically bounded by a transversely extending wall portion 32 that internally defines a relatively deep U-shaped receiving slot 34 of a transverse dimension sized to insertably receive the terminal marginal edges of the fibre board body portion 12 in sliding interfacial relation.

As best shown in FIG. 1, the assembled unit has the terminal marginal edge portions of the front panel 14, the bottom panel portion and the majority of the length of the terminal marginal edges of the back panel portion 16 disposed within the U-shaped slots 34 of the end cap member 10. The terminal edges of the remainder **16*a* of the back panel portion 16, as delineated by means of transverse marginal slots at the ends of the foldline 40, are adapted to overlay the perimetric end cap walls 32 and to provide, in association with the top panel portion 18 and flap portion 20**, a pivotally displaceable cover assembly.

As will be apparent from the foregoing, assembly of the illustrated unit is readily effected by merely inserting the terminal marginal edge portions of the precut and pre-molded fibre board body portion 12 into the receiving slot portions 34 of a pair of end cap members. As pointed out above, the end caps 10 are adapted to be pre-molded of resinous material and the fibre board body portion 12 is formed of cellulose based material. Integral bonding of the fibre board body portion 12 and the interfacially engaged portions of the resinous end caps 10 is readily effected either by precoating those portions of the terminal marginal edges of the body portion 12 adapted to be received within the receiving slots 34 with a compatible adhesive that is adapted to dissolve, merge or integrally bond with the adjacent surfaces of the end cap members 10 when selectively disposed in assembled interfacial engagement therewith, or by allowing capillary action to draw a solvent into the interface between the U channels of the end caps and body member and to dissolve and merge the two. Any number of suitable adhesives can be employed depending upon the specific nature of the resinous material employed for the end cap member 10 and the specific nature of the material incorporated in the body portion 12. The following table, which is presented for illustrative purposes only, identifies suitable adhesive that may be utilized with end caps and body portion elements formed of various resinous material:

| End Cap | Body Portion | Joining Method |
|---|---|---|
| ABS (Acrylonitrile Butadiene Styrene) | ABS | Tetra-hydro furane |
| ABS | Fiberboard (lacquer coated) | Tetra-hydro furane |
| Polystyrene | Fiberboard | Emulsified vinyl cement |
| Polyethylene | Polyethylene | Contact cement |
| Polyethylene | Polyethylene | Heat Seal |

As shown in FIGS. 5 and 6, a lounge chain 50 is constructed in accordance with the concept of the present invention. The lounge chain comprises a single molded or bent piece 52 constructed as described above and shown in dotted lines in FIG. 5. End caps 54 are provided with U-shaped slots 56 disposed around their perimeters to accommodate the terminal edges of the molded or bent piece 52. The construction of this chair is simple and inexpensive while nevertheless providing a sturdy, attractive unit. To assemble the chair, it is merely necessary to insert the terminal marginal edge portions 58 of the bent piece 52 into the slots 56. Then a solvent is usually introduced into the joining area to dissolve, merge and integrally bond the edge portions 58 with the adjacent surfaces of each cap member 54 as described above. Alternately, an adhesive cement can be introduced into the U-shaped slots before the molded piece is inserted. The shape of the "U" slot holds the molded piece in the correct shape while the adhesive is setting (self-jigging). Furthermore, it is within the purview of the present invention to utilize the cap members as the base and/or top of certain types of furniture such as hampers, planters and the like with the panels forming the vertically extending side walls.

While the invention has been described in connection with luggage and furniture, such as chairs, it will be understood that this is merely to facilitate an understanding of the invention and not as a restrictive description as various modifications may be made within the scope of this disclosure. Accordingly, the invention is to be broadly viewed as covering all reasonable modifications and variations which may be made without departing from the spirit of the invention as defined in the appended claims.

What is claimed is:

1. A rigid walled support structure comprising a pair of spaced rigid cap members of resinous material each selectively contoured to provide main rigid walled support panel portions each perimetrically bounded by a transversely extending wall portion defining corresponding internally facing U-shaped receiving and retainer slots; and an intermediate rigid walled unitary support body portion selectively contoured to define boundary portions which correspond to the main panel portions and having a predetermined portion of the terminal marginal edges of the body portion disposed within said receiving slots;

said terminal marginal edges of said body portion being disposed within said U-shaped slots engaging the adjacent interfacial surfaces of said cap members.

2. A supporting structure as set forth in claim 1 wherein said cap members are unitarily molded of a resinous material, and wherein the body portion is adhesively secured thereto.

3. The supporting structure as claimed in claim 1 wherein the intermediate portion as selectively contoured provides panel sections and is extensible therebeyond as desired with the said suction engaging the retainer slots.

4. The structure in claim 1 wherein the intermediate portion forms at least the bottom of a carrying case.

5. The structure claimed in claim 1 wherein the cap members are shaped to provide the shape of the side members of a chair and wherein the retaining slots for the contoured intermediate portion are substantially adjacent to the peripheral portion of the side members.

6. The structure claimed in claim 5 wherein the contoured intermediate portion has its have their edges secured within the retaining slots and is shaped to provide the seat and back-rest of a chair structure.

7. The structure claimed in claim 1 wherein the cap members form the base and top of the structure.

8. The structure claimed in claim 1 wherein the cap members form back and top portion of the structure.

* * * * *